United States Patent [19]

Nishimura et al.

[11] 4,103,668

[45] Aug. 1, 1978

[54] DRESSING APPARATUS FOR GRINDING WHEEL

[75] Inventors: Hideo Nishimura, Nagoya; Kunihiko Etoh, Toyota, both of Japan

[73] Assignee: Toyoda-Koki Kabushiki-Kaisha, Japan

[21] Appl. No.: 818,837

[22] Filed: Jul. 25, 1977

[30] Foreign Application Priority Data

Jul. 30, 1976 [JP] Japan ..... 51-191481
Dec. 24, 1976 [JP] Japan ..... 51-157077

[51] Int. Cl.[2] ..... B24B 53/06
[52] U.S. Cl. ..... 125/11 CD; 51/165.71
[58] Field of Search ..... 51/165 R, 165 TP, 165.71, 51/165.87; 125/11 R, 11 CD, 11 AT, 11 TP

[56] References Cited

U.S. PATENT DOCUMENTS

| | | | |
|---|---|---|---|
| 3,313,285 | 4/1967 | Price | 125/11 R |
| 3,344,559 | 10/1967 | Inaba | 51/165 TP |
| 3,824,743 | 7/1974 | Price | 51/165.71 |

*Primary Examiner*—Harold D. Whitehead
*Attorney, Agent, or Firm*—Oblon, Fisher, Spivak, McClelland & Maier

[57] ABSTRACT

A dressing apparatus for dressing a grinding wheel having straight and circular portions by a dressing tool which is moved by a pair of servomotors. A mode counter designates a mode of dressing operation on the straight and circular portions. A memory device stores numerical information to move the dressing tool along the circular portion. A gate circuit distributes clock pulses to both the servomotors in accordance with the content of the mode counter and the memory device, when the mode counter designates a dressing operation on the circular portion and distributes clock pulses to one of the servomotors in accordance with the content of the mode counter, when the mode counter designates a dressing operation on the straight portion.

7 Claims, 4 Drawing Figures

DRESSING APPARATUS FOR GRINDING WHEEL

BACKGROUND OF THE INVENTION

1. Field of the Invention

The present invention relates to a dressing apparatus wherein a dressing tool is moved by a pair of servomotors in directions perpendicular to each other to dress straight and circular portions of a grinding wheel.

2. Description of the Prior Art

In a conventional dressing apparatus which is controlled by a pair of servomoters to continuously dress straight and circular portions of a grinding wheel, a punched or magnetic tape stored control information for both the straight and circular portions and a tape reader read out this control information. In such a conventional dressing apparatus, control circuits for both linear and circular interpolations were therefore complicated and the tape reader was necessarily required, which resulted in expensive apparatus.

SUMMARY OF THE INVENTION

It is therefore an object of the present invention to provide a new and improved dressing apparatus which is simple in construction and inexpensive in cost.

Another object of the present invention is to provide a new and improved dressing apparatus which comprises a mode counter controlling a mode of a dressing operation on straight and circular portions of a grinding wheel.

A further object of the present invention is to provide a new and improved dressing apparatus of the character as set forth above, wherein a memory device stores numerical information to move a dressing tool along the circular portion of the grinding wheel.

Briefly, according to the present invention, these and other objects are achieved by providing a dressing apparatus for dressing a grinding wheel having a straight portion and a circular portion continuous to the straight portion, as mentioned below. A first servomoter is operably connected to a dressing tool for moving the same in a direction parallel with the axis of the grinding wheel. A second servomotor is operably connected to the dressing tool for moving the same in a direction perpendicular to the axis of the grinding wheel. A mode counter designates a mode of a dressing operation on the straight and circular portions of the grinding wheel, depending upon the content thereof. A memeory device stores numerical information to move the dressing tool along the circular portion of the grinding wheel. A pulse generator generates a train of clock pulses. A first gate circuit is operably connected to the mode counter, the memory device and the pulse generator for distributing clock pulses from the pulse generator to the first and second servomotors in accordance with the content of the mode counter and the memeory device, when the mode counter designates a dressing operation on the circular portion. Means is provided to generate a signal to be applied to the mode counter to change a mode of a dressing operation, when the pulse distribution is completed by the first gate circuit. Setting means sets a moving amount of the dressing tool to dress the straight portion of the grinding wheel. A second gate circuit is operably connected to the mode counter and the pulse generator for distributing clock pulses from the pulse generator to one of the first and second servomotors in accordance with the content of the mode counter, when the mode counter designates a dressing operation on the straight portion. Means is provided to generate a signal to be applied to the mode counter to change a mode of a dressing operation, when the dressing tool is moved by one of the first and second servomoters along the straight portion of the grinding wheel by the moving amount set in the setting means.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
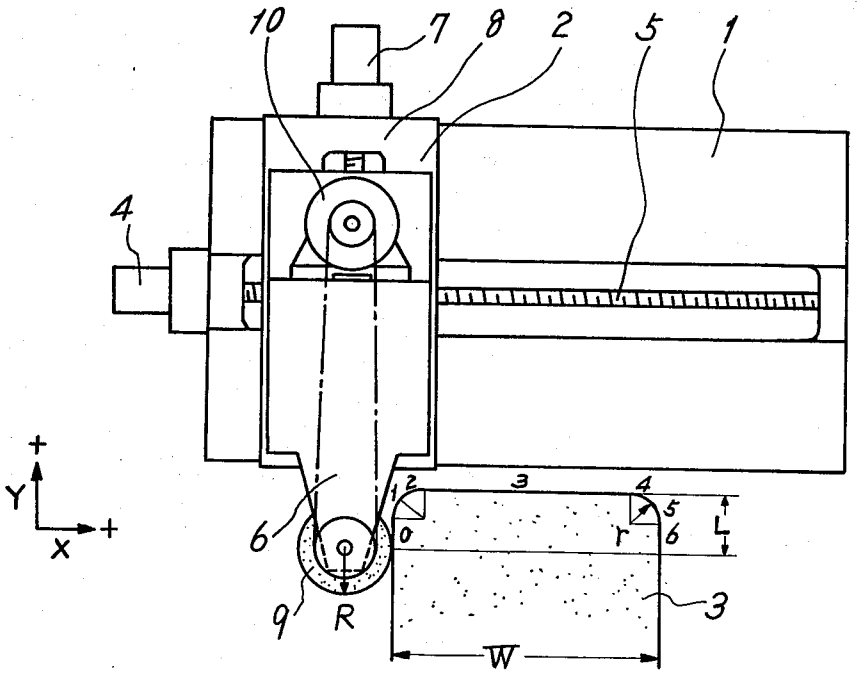
FIG. 1 is a plan view of a grinding wheel dressing apparatus according to the present invention.

Referring now to the drawings, wherein like reference numerals or characters refer to identical or corresponding parts throughout the several views, and more particularly to FIG. 1, there is shown a grinding wheel dressing apparatus which comprises a base 1 on which a first slide member 2 is slidably mounted to be slidable in an X-direction parallel to the axis of a grinding wheel 3 to be dressed. A servomotor 4 is secured to the base 1 to move the first slide member 2 in the X-direction through a feed screw shaft 5. A second slide member 6 is slidably mounted on the first slide member 2 to be slidable in a Y-direction perpendicular to the X-direction. A servomotor 7 is secured to the first slide member 2 to move the second slide member 6 in the Y-direction through a feed screw shaft 8. A rotary diamond dressor 9 with a radius R is rotatably mounted on one end of the second slide member 6 and is driven by a motor 10 mounted on the other end of the second slide member 6.

The grinding wheel 3 is adapted to be dressed into a shape having a width W and two round corners with a radius *r* on both peripheral sides. In order to dress the grinding wheel 3 into such a shape, the rotary dressor 9 is moved along the straight portion on the left side of the grinding wheel 3 (defined as 0 portion), the first one-eighth circle on the left round corner (1st portion), the second one-eighth circle on the left round corner (2nd portion), the straight portion on the periphery (3rd portion), the first one-eighth circle on the right round corner (5th portion), and the straight portion on the right portion (6th portion), as shown in FIG. 1.

Figure 3:
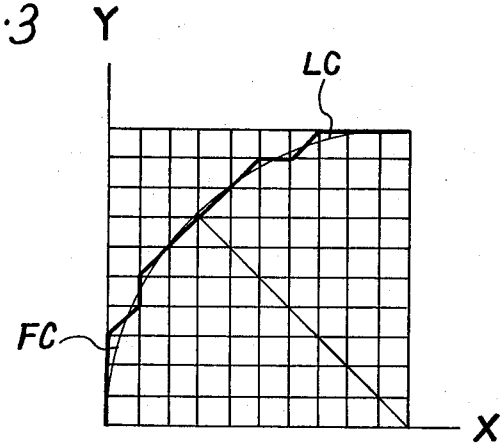
FIG. 3 shows a partial travelling path of a rotary dressor.
Figure 4:
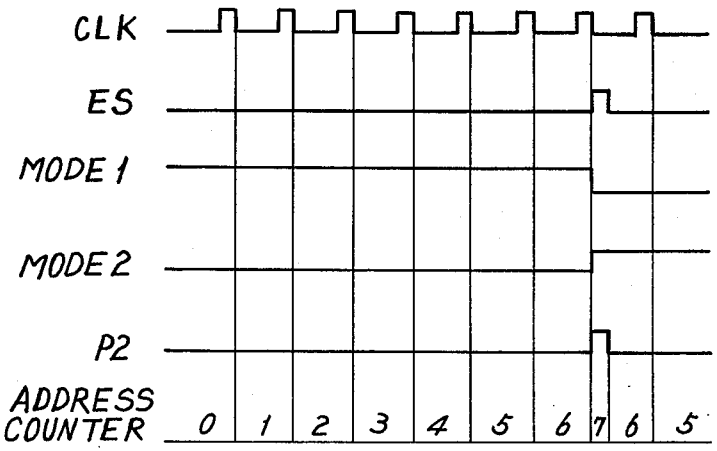
FIG. 4 shows a time chart of various timing signals.
Figure 2:
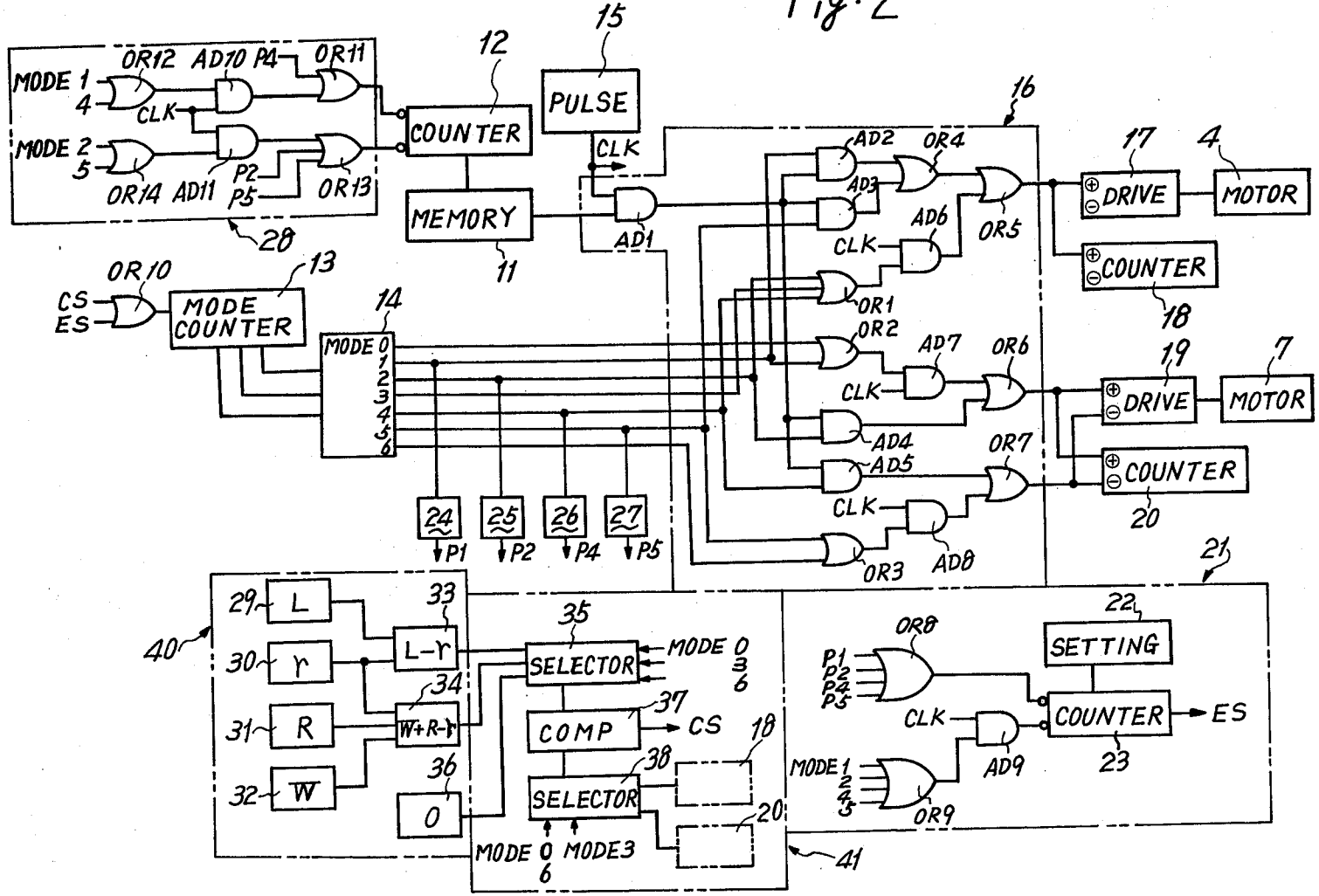
FIG. 2 is a control circuit diagram for the grinding wheel dressing apparatus.

Referring now to FIG. 2, a read-only memory 11 stores numerical information or data to move the rotary dressor 9 along the 1st portion of the grinding wheel 3, which is enlarged as FC in FIG. 3. An example of this numerical information is shown in TABLE 1 and indicates at memory addresses 0 to 6 of the memory 11 an existence (1) or non-existence (0) of a clock pulse to be applied to the servomotor 4 for the X-direction under the condition that a train of clock pulses are continuously applied to the servomotor 7 for the Y-direction.

TABLE 1

| address | (−1) | 0 | 1 | 2 | 3 | 4 | 5 | 6 | (7) |
|---|---|---|---|---|---|---|---|---|---|

TABLE 1-continued

| | | | | | | | | | |
|---|---|---|---|---|---|---|---|---|---|
| numerical information | (0) | 0 | 0 | 0 | 1 | 0 | 1 | 1 | (0) |

An address counter 12 is connected to the memory 11 to designate an address of the memory 11 to read out the content thereof. A mode counter 13 is provided to designate a mode of a grinding operation on one of the 0 to 6th portions of the grinding wheel 3 to be dressed and reading-out direction of the memeory 11, depending upon the content thereof. A decoder 14 is connected to the mode counter 13 to decode the content of the mode counter 13 and to generate an output signal at one of its mode terminals 0 to 6, depending upon the content of the mode counter 13.

A gate circuit 16 is provided to distribute clock pulses CLK, which are generated from a pulse generator 15, to both the servomotors 4 and 7 in accordance with the content of the mode counter 13 and numerical information read out from the memory 11, when the mode counter 13 designates a dressing operation on the circular portion such as 1st, 2nd, 4th and 5th portions of the grinding wheel 3. The gate circuit 16 also distributes clock pulses to only one of the servomotors 4 and 7 in accordance with the content of the mode counter 13, when the mode counter 13 designates a dressing operation on the straight portion such as 0, 3rd and 6th portions. The gate circuit 16 comprises an AND circuit AD1 which is connected at its input terminals to the memory 11 and the pulse generator 15 and at its output torminal to input terminals of AND circuits AD2, AD3, AD4 and AD5. The other input terminals of the AND circuits AD2, AD3, AD4 and AD5 are respectively connected to mode terminals, 1, 5, 2 and 4 of the decoder 14. An OR circuit OR1 is connected at its input terminals to mode terminals 2, 3 and 4 of the decoder 14. An OR circuit OR2 is connected at its input terminals to mode terminals 0 and 1 of the decoder 14. An OR circuit OR3 is connected at its input terminals to mode terminals 5 and 6 of the decoder 14. An OR circuit OR4 is connected at its input terminals to the output terminals of the AND circuits AD2 and AD3. The output terminal of the pulse generator 15 is connected to input terminals of AND circuits AD6, AD7 and AD8. The other input terminals of the AND circuits AD6, AD7 and AD8 are respectively connected to the output terminals of the OR circuits OR1, OR2 and OR3. An OR circuit OR5 is connected at its input terminals to the output terminals of the OR circuit OR4 and the AND circuit AD6. The output terminal of the OR circuit OR5 is connected to a normal-rotation terminal of a driving circuit 17 for the servomotor 4 and an addition terminal of a counter 18 for counting a moving amount of the first slide member 2 in the X-direction. An OR circuit OR6 is connected at its input terminals to the output terminals of the AND circuits AD4 and AD7. The output terminal of the OR circuit OR6 is connected to a normal-rotation terminal of a driving circuit 19 for the servomotor 7 and an addition terminal of a counter 20 for counting a moving amount of the second slide member 6 in the Y-direction. An OR circuit OR7 is connected at its input terminals to the output terminals of the AND circuits AD5 and AD8. The output terminal of the OR circuit OR7 is connected to a reverse-rotation terminal of the driving circuit 19 and a subtraction terminal of the counter 20.

A circuit 21 is provided for indicating a completion of a dressing operation on a circular portion of the grinding wheel 3. The circuit 21 generates a signal ES in order to increase the content of the mode counter 13 one by one, when a pulse distribution for a circular portion of the grinding wheel 3 is completed. The circuit 21 comprises a setting device 22, such as a digital switch, into which the number of pulses to be continuously applied to the servomotor 7 is set for moving the rotary dressor 9 along the circular portion FC, and a subtraction counter 23 into which the content of the setting device 22 is preset when receiving a signal at its set terminal. A value "7" is set into the setting device 22 in the example shown in TABLE 1. The set terminal of the subtraction counter 23 is connected to an output terminal of an OR circuit OR8 whose input terminals are connected to pulse forming circuits 24, 25, 26 and 27 to receive pulse signals P1, P2, P3 and P4, respectively. The pulse forming circuits 24, 25, 26 and 27 are respectively connected to mode terminals 1, 2, 4 and 5 of the decoder 14. A subtraction terminal of the subtraction counter 23 is connected to an output terminal of an AND circuit AD9 whose input terminals are connected to output terminals of the pulse generator 15 and an OR circuit OR9. The input terminals of the OR circuit OR9 are connected to mode terminals 1, 2, 4 and 5. A zero terminal of the subtraction counter 23 is connected to the input terminal of the mode counter 13 through an OR circuit OR10 to apply the signal ES thereto when the content of the subtraction counter 23 becomes "0".

An address counter control circuit 28 is provided for increasing or decreasing the content of the address counter 12 in accordance with the content of the mode counter 13, each time a clock pulse CLK is generated from the pulse generator 15. The control circuit 28 comprises an OR circuit OR11 whose output terminal is connected to the up-terminal of the address counter 12. The input terminals of the OR circuit OR11 are connected to output terminals of an AND circuit AD10 and the pulse forming circuit 26. The input terminals of the AND circuit AD10 are connected to output terminals of an OR circuit OR12 and to pulse generator 15. The input terminals of the OR circuit OR12 are connected to mode terminals 1 and 4 of the decoder 14. An OR circuit OR13 is connected at its output terminal to the down-terminal of the address counter 12 and at its input terminals to output terminals of the pulse forming circuits 25 and 27 and an AND circuit AD11. The input terminals of the AND circuit AD11 are connected to output terminals of an OR circuit OR14 and the pulse generator 15. The input terminals of the OR circuit OR14 are connected to mode terminals 2 and 5 of the decoder 14.

A setting circuit 40 is provided to set moving amounts of the rotary dressor 9 in either X-or Y-direction in order to dress the straight portions (0, 3rd and 6th portions) of the grinding wheel 3. The setting circuit 40 comprises setting devices 29 to 32, such as digital switches. A distance L between a dressing start point on the grinding wheel side and the periphery of the grinding wheel is set in the setting device 29. The radius $r$ of the round corner of the grinding wheel 3, the width W of the grinding wheel, and the radius R of the rotary dressor 9 are set in the setting devices 30, 31 and 32, respectively. An arithmetic device 33 is connected to the setting devices 29 and 30 to calculate an amount $(L - r)$. An arithmetic device 34 is connected to the setting devices 30, 31 and 32 to calculate an amount $(W + R - r)$. An amount "0" is set in a setting device 36. There is provided a circuit 41 for indicating a completion of a dressing operation on a straight portion of the grinding wheel 3. The circuit 41 generates a signal CS to increase the content of the mode counter 13 when the rotary dressor 9 is moved, by one of the servomotors 4 and 7, a distance set by the setting circuit 40. The circuit 41 comprises a selector 35 which selectively connects the arithmetic devices 33 and 34 and the setting device 36 with a comparator 37 when receiving signals from the mode terminals 0, 3, and 6 of the decoder 14, respectively. A selector 38 connects the counter 18 with the comparator 37 when receiving a signal from the mode terminal 3 of the decoder 14 and connects the counter 20 with the comparator 37 when receiving a signal from one of the mode terminals 0 and 6 of the decoder 14. A coincidence signal terminal of the comparator 37 is connected to the addition terminal of the mode counter 13 through the OR circuit CR10 to apply the signal CS thereto when a coincidence is found.

The operation of the above described embodiment will now be described. When a grinding wheel dressing command is applied, all counters are reset to their initial states. Therefore, the decoder 14 generates a signal from its mode terminal 0 and thus the clock pulses CLK are applied to the normalrotation terminal of the driving circuit 19 and to the addition terminal of the counter 20 from the pulse generator 15 through the AND circuit AD7 and the OR circuit OR6. The rotary dressor 9 is therefore moved in the Y-direction to dress the 0 portion of the grinding wheel 3. With the signal being generated from the mode terminal 0 of the decoder 14, the selectors 35 and 38 respectively connect the setting device 33 and the counter 20 with the comparator 37. When the content of the counter 20 becomes the amount $(L - r)$ set in the setting device 33, the comparator 37 generates a coincidence signal CS which is applied through the OR circuit OR10 to the mode counter 13 to advance the content thereof into "1", whereby the dressing operation on the 0 portion of the grinding wheel 3 is completed.

When the content of the mode counter 13 becomes "1", the decoder 14 generates a signal from its mode terminal 1 which is applied to the pulse forming circuit 24. A pulse signal P1 is applied to the set terminal of the subtraction counter 23 from the pulse forming circuit 24 through the OR circuit OR8, whereby the set value "7" of the setting device 22 is preset in the substraction counter 23. When a clock pulse CLK is thereafter generated from the pulse generator 15, this clock pulse CLK is applied to the normalrotation terminal of the driving circuit 19 and to the addition terminal of the counter 20 through the AND circuit AD7 receiving a signal from the mode terminal 1 of the decoder 14 through the OR circuit OR2, and the OR circuit OR6. The servomotor 7 is thus rotated in the normal direction to move the rotary dressor 9 in the Y-direction. When this first clock pulse CLK is generated, the content of the address counter 12 is "0". Since the memory 11 stores numerical data "0" at its 0 address, as indicated in TABLE 1, and AND circuit AD1 remains closed so that the first clock pulse CLK is not applied to the driving circuit 17 for the servomotor 4. Accordingly, the rotary dressor 9 is not moved in the X-direction. The first clock pulse CLK is also applied to the up-terminal of the address counter 12 through the AND circuit AD10 receiving a signal from the mode terminal 1 of the decoder 14 through the OR circuit OR12, and the OR circuit OR11, so that the content of the address counter 12 becomes "1" at the moment the first clock pulse CLK disappears. When second and third clock pulses CLK are generated from the pulse generator 15, the rotary dressor 9 is moved only in the Y-direction, and the content of the address counter 12 becomes "2" and "3" in the same way as the first clock pulse. A fourth clock pulse CLK is applied to the driving circuit 19 through the AND circuit AD7 and the OR circuit OR6. At the same time, the fourth clock pulse CLK is applied to the driving circuit 17 through the AND circuit AD1 receiving numerical data "1" from the memory address 3 of the memory 11, the AND circuit AD2 receiving a signal from the mode terminal 1 of the decoder 14, and the OR circuits OR4 and OR5. Accordingly, the rotary dressor 9 is moved simultaneously in the X- and Y-directions. In a similar way, a train of clock pulses CLK are continuously applied to the driving circuit 19 for the Y-direction, while the driving circuit 17 for the X-direction selectively receives clock pulses CLK in accordance with numerical data stored in the memory 11. In consequence, the rotary dressor 9 is moved along the circular portion FC shown in FIG. 3 to dress the 1st portion of the grinding wheel 3.

Furthermore a train of clock pulses are applied to the subtraction terminal of the subtraction counter 23 through the AND circuit AD9 receiving a signal from the mode terminal 0 of the decoder 14 through the OR circuit OR9, so that the content of the subtraction counter 23 is subtracted one by one each time a clock pulse is applied thereto. When seven clock pulses corresponding in number to the set value of the setting device 22 are applied to the subtraction counter 23, the content thereof becomes "0" to issue a distribution completion signal ES from its zero terminal to thereby indicate a completion of a dressing operation on the 1st portion of the grinding wheel 3. The signal ES is applied through the OR circuit OR10 to the mode counter 13 to increase the content thereof into "2" to thereby cause the decoder 14 to generate a signal from its mode terminal 2.

In order to move the rotary dressor 9 along the latter circular portion LC shown in FIG. 3, a train of clock pulses are to be continuously applied to the driving circuit 17 for the X-direction and the driving circuit 19 for the Y-direction is to selectively receive clock pulses in accordance with numerical data stored in the memory 11 which data is reversely read out from the memory address 6 to the memory address 0. However, when a seventh clock pulse CLK disappers in a pulse distribution for the former circular portion FC, the content of the address counter 12 becomes "7". It is therefore necessary to change the content of the address counter 12 into "6". For this purpose, a pulse signal P2 generated from the pulse forming circuit 25 based upon a signal from the mode terminal 2 of the decoder 14 is applied to the down-terminal of the address counter 12 through the OR circuit OR13 to thereby change the content thereof into "6". This pulse signal P2 is also applied to the set terminal of the subtraction circuit 23 through the OR circuit OR8, whereby the set value "7" of the setting device 22 is again preset in the subtraction counter 23. When a clock pulse CLK is thereafter generated from the pulse generator 15 under these conditions, this clock pulse CLK is applied to the driving circuit 17 for the X-direction through and AND circuit AD6 receiving a signal from the mode terminal 2 of the decoder 14 through the OR circuit OR1, and the OR circuit OR5. At the same time this clock pulse CLK is also applied to the driving circuit 19 for the Y-direction through the AND circuit AD1 receiving numerical data "1" from the memory address 6 of the memory 11, the AND circuit AD4 receiving a signal from the mode terminal 2 of the decoder 14, and the OR circuit OR6. Accordingly, the rotary dressor 9 is moved simultaneously in the X- and Y-directions. This clock pulse CLK is also applied to the down-terminal of the address counter 12 through the AND circuit AD11 receiving a signal from the mode terminal 2 of the decoder 14 through the OR circuit OR14, and the OR circuit OR13, so that the content of the address counter 12 becomes "5" at the moment this clock pulse CLK disappears. In a similar way, the rotary dressor 9 is moved along the latter circular portion LC to dress the 2nd portion of the grinding wheel 3.

When a pulse distribution for the latter circular portion LC is completed, a distribution completion signal ES is generated from the subtraction counter 23 to thereby advance the content of the mode counter 13 into "3". A signal is therefore generated from the mode terminal 3 of the decoder 14 so that a train of clock pulses CLK are applied to the normalrotation terminal of the driving circuit 17 for the X-direction and to the addition terminal of the counter 18 through the AND circuit AD6 and the OR circuit OR5 to move the rotary dressor 9 only in the X-direction. When the content of the counter 18 coincides with the content $(W + R - r)$ set in the setting device 34, the comparator 37 generates a coincidence signal CS which causes the mode counter 13 to advance the content thereof, whereby the dressing operation on the 3rd portion of the grinding wheel 3 is completed.

In a similar way, the dressing operation is successively performed on the 4th, 5th and 6th portions of the grinding wheel 3.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A dressing apparatus for dressing a grinding wheel having a straight portion and a circular portion continuous to the straight portion comprising:

a dressing tool for dressing the grinding wheel;

a first servomotor operably connected to said dressing tool for moving the same in a direction parallel with the axis of the grinding wheel;

a second servomotor operably connected to said dressing tool for moving the same in a direction perpendicular to the axis of the grinding wheel;

a mode counter for designating a mode of a dressing operation on the straight and circular portions of the grinding wheel, depending upon the content thereof;

a memory device for storing numerical information to move said dressing tool along the circular portion of the grinding wheel;

a pulse generator for generating a train of clock pulses;

a first gate circuit operably connected to said mode counter, said memory device and said pulse generator for distributing clock pulses from said pulse generator to said first and second servomotors in accordance with the content of said mode counter and said memory device, when said mode counter designates a dressing operation on the circular portion;

means for generating a signal to be applied to said mode counter to change a mode of a dressing operation, when the pulse distribution is completed by said first gate circuit;

setting means for setting a moving amount of said dressing tool to dress the straight portion of the grinding wheel;

a second gate circuit operably connected to said mode counter and said pulse generator for distributing clock pulses from said pulse generator to one of said first and second servomotors in accordance with the content of said mode counter, when said mode counter designates a dressing operation on the straight portion; and means for generating a signal to be applied to said mode counter to change a mode of a dressing operation, when said dressing tool is moved by one of said first and second servomotors along the straight portion of the grinding wheel by the moving amount set in said setting means.

2. A dressing apparatus for dressing a grinding wheel having a straight portion and a circular portion continuous to the straight portion comprising:

a dressing tool for dressing the grinding wheel;

a first servomotor operably connected to said dressing tool for moving the same in a direction parallel with the axis of the grinding wheel;

a second servomotor operably connected to said dressing tool for moving the same in a direction perpendicular to the axis of the grinding wheel;

a mode counter for designating a mode of a dressing operation on the straight and circular portions of the grinding wheel;

a decoder connected to said mode counter for decoding the content of said mode counter to generate a signal at its one terminal when said mode counter designates a dressing operation on the straight portion and to generate a signal at its another terminal when said mode counter designates a dressing operation on the circular portion;

a pulse generator for generating a train of clock pulses;

a memory device for storing at memory addresses thereof numerical information to drive one of said first and second servometers in a dressing operation on the circular portion;

an address counter connected to said memory device to designate an address of said memory device to read out the content thereof;

a first gate circuit responsive to said another terminal of said decoder, said memory device and said pulse generator for causing one of said first and second servomotors to be driven in accordance with the content of said memory device and responsive to said another terminal of said decoder and said pulse generator for causing the other of said first and second servomotors to be driven in a dressing operation on the circular portion;

a second gate circuit responsive to said one terminal of said decoder and said pulse generator for causing one of said first and second servomotors to be driven in a dressing operation on the straight portion;

a third gate circuit responsive to said another terminal of said decoder and said pulse generator for changing the content of said address counter;

means for changing the content of said mode counter to change a mode of a dressing operation, when a dressing operation on the straight portion is completed; and means for changing the content of said mode counter to change a mode of a dressing operation, when a dressing operation on the circular portion is completed.

3. A dressing apparatus for dressing a grinding wheel having a first straight portion at its one side, a first one-eighth-circle portion continuous to the first straight portion, a second one-eighth-circle portion continuous to the first circle portion, a second straight portion continuous to the second circle portion and at its periphery comprising:

a dressing tool for dressing the grinding wheel;

a first servomotor operably connected to said dressing tool for moving the same in a direction parallel with the axis of the grinding wheel;

a second servomotor operably connected to said dressing tool for moving the same in a direction perpendicular to the axis of the grinding wheel;

a mode counter for designating a mode of a dressing operation;

a decoder connected to said mode counter for decoding the content of said mode counter to generate a signal at one of its first to fourth terminals which respectively correspond to dressing operations on the first straight, first and second circle, and second straight portions;

a pulse generator for generating a train of clock pulses;

a memory device for storing at memory addresses thereof numerical information to drive said first servomotor in a dressing operation on the first circle portion;

an address counter connected to said memory device to designate an address of said memory device to read out the content thereof;

a first gate circuit responsive to said memory device and said pulse generator to generate a signal in accordance with the content of said memory device;

a second gate circuit responsive to said first terminal of said decoder and said pulse generator for causing said second servomotor to be driven in a dressing operation on the first straight portion, responsive to said second terminal and said first gate circuit for causing said first servomotor to be driven and responsive to said second terminal and said pulse generator for causing said second servomotor to be driven in a dressing operation on the first circle portion, responsive to said third terminal and said first gate circuit for causing said second servomotor to be driven and responsive to said third terminal and said pulse generator for causing said first servomotor to be driven in a dressing operation on the second circle portion, and responsive to said fourth terminal and said pulse generator for causing said first servomotor to be driven in a dressing operation on the second straight portion;

a third gate circuit responsive to said second terminal and said pulse generator for increasing the content of said address counter and responsive to said third terminal and said pulse generator for decreasing the content of said address counter;

first means for increasing the content of said mode counter to change a mode of a dressing operation, when a dressing operation on one of the first and second straight portions is completed; and second means for increasing the content of said mode counter to change a mode of a dressing operation, when a dressing operation on one of said first and second circle portions is completed.

4. A dressing apparatus as claimed in claim 3, wherein said dressing tool is a rotary diamond dressor.

5. A dressing apparatus as claimed in claim 3, wherein said third gate circuit comprises means responsive to said third terminal of said decoder to decrease the content of said address counter prior to a dressing operation on the second circle portion.

6. A dressing apparatus as claimed in claim 3, wherein said first means comprises:

a first setting device for setting a moving amount of said dressing tool in a dressing operation on the first straight portion;

a second setting device for setting a moving amount of said dressing tool in a dressing operation on the second straight portion;

a first selector responsive to said first terminal of said decoder to select the content of said first setting device and responsive to said fourth terminal of said decoder to select the content of said second setting device;

a second selector responsive to said first terminal of said decoder to indicate an actual moving amount of said dressing tool in a dressing operation on the first straight portion and responsive to said fourth terminal of said decoder to indicate an actual moving amount of said dressing tool in a dressing operation on the second straight portion; and a comparator connected to said first and second setting devices for comparing the contents of said first and second setting devices and for generating a signal to increase the content of said mode counter when the contents of said first and second setting devices coincide.

7. A dressing apparatus as claimed in claim 3, wherein said second means comprises:

a setting device for setting a predetermined number therein; and a counter responsive to one of said second and third terminals to receive the content of said setting device and responsive to said pulse generator and one of said second and third terminals of said decoder to generate a signal to increase the content of said mode counter when the content thereof becomes zero.

* * * * *

UNITED STATES PATENT AND TRADEMARK OFFICE

CERTIFICATE OF CORRECTION

PATENT NO. : 4,103,668

DATED : August 1, 1978

INVENTOR(S) : Hideo Nishimura et al

It is certified that error appears in the above-identified patent and that said Letters Patent are hereby corrected as shown below:

Please Correct the Priority Data to read as follows:

[30] Jul. 30, 1976 Japan.....51-91481

Dec. 24, 1976 Japan.....51-157077

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*